US012678676B2

(12) United States Patent
Luo

(10) Patent No.: US 12,678,676 B2
(45) Date of Patent: Jul. 14, 2026

(54) PORTABLE PICKLEBALL TRAINING NET

(71) Applicant: Chunfang Luo, Dongguan (CN)

(72) Inventor: Chunfang Luo, Dongguan (CN)

( * ) Notice: Subject to any disclaimer, the term of this patent is extended or adjusted under 35 U.S.C. 154(b) by 668 days.

(21) Appl. No.: 18/115,772

(22) Filed: Mar. 1, 2023

(65) Prior Publication Data

US 2024/0261651 A1 Aug. 8, 2024

(30) Foreign Application Priority Data

Feb. 7, 2023 (CN) ..... 202320145073.4

(51) Int. Cl.
*A63B 61/00* (2006.01)
*A63B 69/38* (2006.01)

(52) U.S. Cl.
CPC ..... *A63B 61/003* (2013.01); *A63B 69/38* (2013.01); *A63B 2210/50* (2013.01)

(58) Field of Classification Search
CPC ... A63B 61/003; A63B 69/38; A63B 2210/50; A63B 2063/001; A63B 63/00; A63B 63/004; A63B 69/0097; A63B 71/022; A63B 71/023; Y02A 40/81
See application file for complete search history.

(56) References Cited

U.S. PATENT DOCUMENTS 4,239,235 A * 12/1980 Torres ..... A63B 69/0097 473/434
5,833,234 A * 11/1998 Vavala ..... A63B 69/0097 273/400
8,590,901 B2 * 11/2013 Goldwitz ..... A63B 63/00 473/434
9,486,691 B1 * 11/2016 McGee ..... A63B 71/022
2021/0060396 A1 * 3/2021 Fedon ..... A63B 63/00
2021/0316199 A1 * 10/2021 Coulter ..... A63B 69/0097

* cited by examiner

*Primary Examiner* — Michael D Dennis
(74) *Attorney, Agent, or Firm* — Hemisphere Law, PLLC

(57) ABSTRACT

A portable pickleball training net applied in the pickleball sport is provided, including a bracket and a rebound net mounted on the bracket. The bracket includes a bending part, a supporting part, and connecting parts. The bending part and the supporting part are hinged to the connecting parts. A first groove configured to accommodate an end of the bending part and an end of the supporting part is provided in each of the connecting parts. An outlet direction of the first groove is set forward so that the bending part or the supporting part can be rotated forward to fold the bending part and the supporting part. Rears of bottoms of the supporting part are connected to a supporting base, and detachable adjusting assembly is connected between the supporting base and the supporting part. The supporting part, the supporting base and adjusting assembly form a triangular supporting structure.

9 Claims, 7 Drawing Sheets

PORTABLE PICKLEBALL TRAINING NET

TECHNICAL FIELD

The disclosure relates to the field of pickleball, in particular to a portable pickleball training net.

BACKGROUND

Pickleball is a sport in which the ball is hit with a paddle. Conventional pickleball requires a high level of playground and at least one player to cooperate. Understandably, it is not difficult to make an appointment with a player to play the pickleball at a certain time and place, but it is not easy to find a player who can cooperate with training anytime and anywhere during daily training. Therefore, for those who like the pickleball, it is troublesome to carry out daily training.

SUMMARY

In order to overcome the above shortcomings, a purpose of the disclosure is to provide technical solutions to solve the above problems.

A portable pickleball training net, applied to a pickleball sport, including: a bracket and a rebound net mounted on the bracket. The bracket includes: a bending part, a supporting part, and connecting parts; the bending part and the supporting part are hinged to the connecting parts; each of the connecting parts is formed with a first groove configured to accommodate an end of the bending part and an end of the supporting part; the end of the bending part and the end of the supporting part are disposed at two ends inside the first groove respectively; an opening direction of the first groove faces towards a first direction so that at least one of the bending part and the supporting part is capable of being rotated facing towards the first direction to fold the bending part and the supporting part. The supporting part is located below the bending part, bottoms of the supporting part are connected to a supporting base being rotatable and arranged along a second direction opposite to the first direction, and a detachable adjusting assembly is connected between the supporting base and each of the supporting parts; the supporting part, the supporting base and the detachable adjusting assembly form a triangular supporting structure; and the detachable adjusting assembly is configured to adjust a tilt angle of the bracket.

In an embodiment, the detachable adjusting assembly includes supporting rods; an upper end of each of the supporting rods is hinged to the supporting part, a lower end of each of the supporting rods is detachably connected to the supporting base, the supporting base is formed with multiple through holes, a side surface of the lower end of each of the supporting rods is provided with an inserting rod, and the inserting rod is mounted in any one of the multiple through holes.

In an embodiment, a side of the inserting rod is formed with a threaded hole, and a bolt matched with the thread hole is mounted the side of the inserting rod.

In an embodiment, the detachable adjusting assembly includes a connecting piece, an adjusting rod, and a supporting piece; the connecting piece is mounted on a middle section of the supporting part and is rotatably matched with the middle section; an end of the supporting piece is hinged to the supporting base; an end surface of another end of the supporting piece is formed with a first inserting hole, the connecting piece is formed with a second inserting hole, and two ends of the adjusting rod are respectively inserted in the first inserting hole and the second inserting hole.

In an embodiment, the first inserting hole is provided with a plurality of notches distributed around thereon, and the first inserting hole is sleeved with a clamp; and the clamp is configured to fix the adjusting rod and the supporting piece when the adjusting rod is inserted into the second inserting hole.

In an embodiment, each of the bottoms of the supporting part is provided with a base, and the base is in ʃ -shaped; the supporting part and the supporting base are hinged to the base, the base is formed with a second groove configured to accommodate the bottom of the supporting part and an end of the supporting base, the bottom of the supporting part and the end of supporting base are respectively arranged at two ends inside the second groove, and an opening direction of the second groove faces towards the second direction; when the inserting rod is removed from the through hole, the supporting part is capable of being rotated facing towards the second direction to fold the supporting part and the supporting base.

In an embodiment, the connecting part is detachably mounted with a first pin and a second pin, the first pin passes through the connecting part and the bending part to fix the bending part on the connecting part, and the second pin passes through the connecting part and the supporting part to fix the supporting part on the connecting part.

In an embodiment, the bracket is provided with multiple hook buckles to fix the rebound net.

Compared with the prior art, the disclosure has the following beneficial effects: the training net of the disclosure can assist the trainers to complete individual training and has low requirements for the field. It can be folded and thus is convenient be carried, and can also adjust the tilt angle of the bracket as needed.

The additional aspects and advantages of the disclosure will be partly given in the following description, and some of them will be clearer from the following description or understood from the embodiments of the disclosure.

BRIEF DESCRIPTION OF DRAWINGS

In order to illustrate the embodiments or the technical solutions of the disclosure more clearly, the following is a brief description of the drawings required in the description of the embodiments. Apparently, the drawings in the following description are only some embodiments of the disclosure. For those ordinary skilled in the art, other drawings can also be obtained from these drawings without paying creative work.

DESCRIPTION OF REFERENCE NUMERALS

Figure 1:
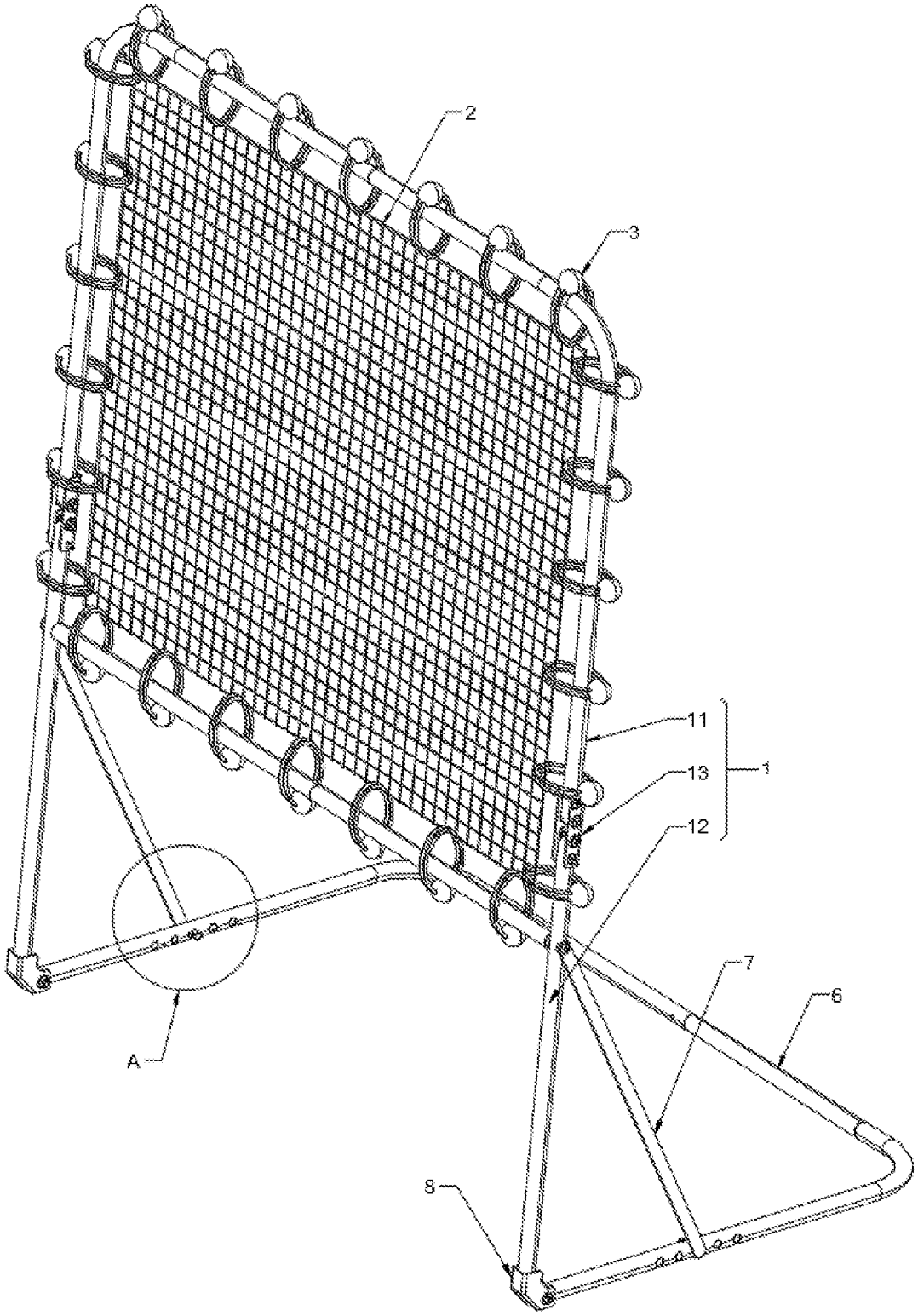
FIG. 1 is a schematic structural view of a portable pickleball training net according to a first embodiment of the disclosure.
Figure 2:
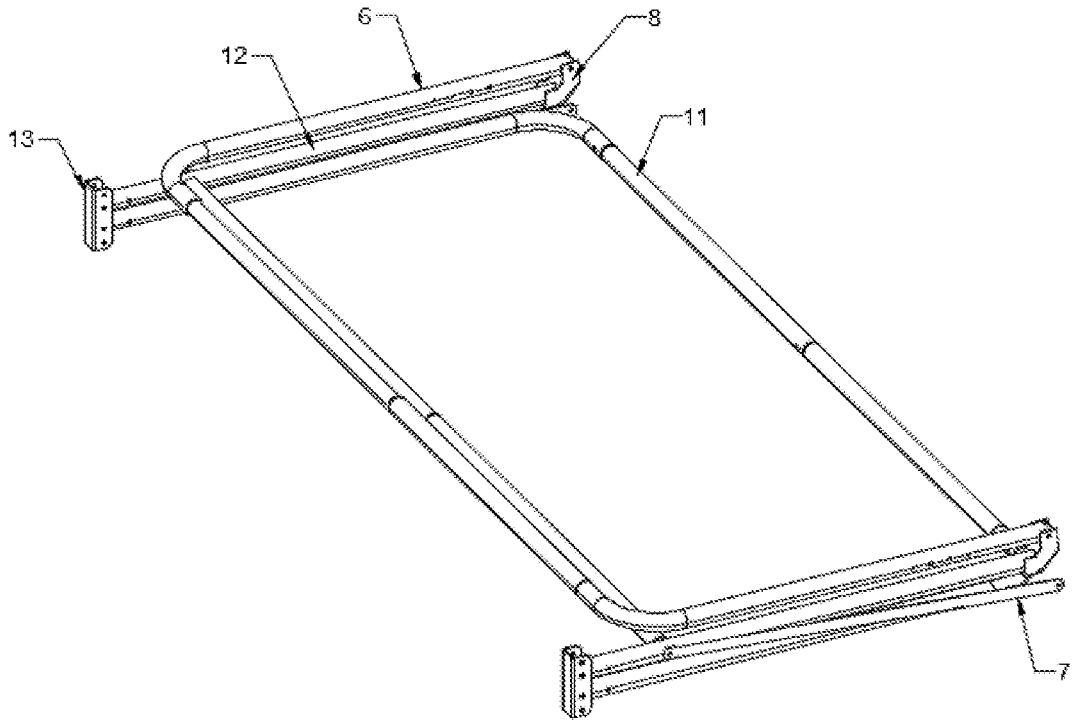
FIG. 2 is a schematic structural view of the portable pickleball training net in a folding state according to the first embodiment of the disclosure.
Figure 3:
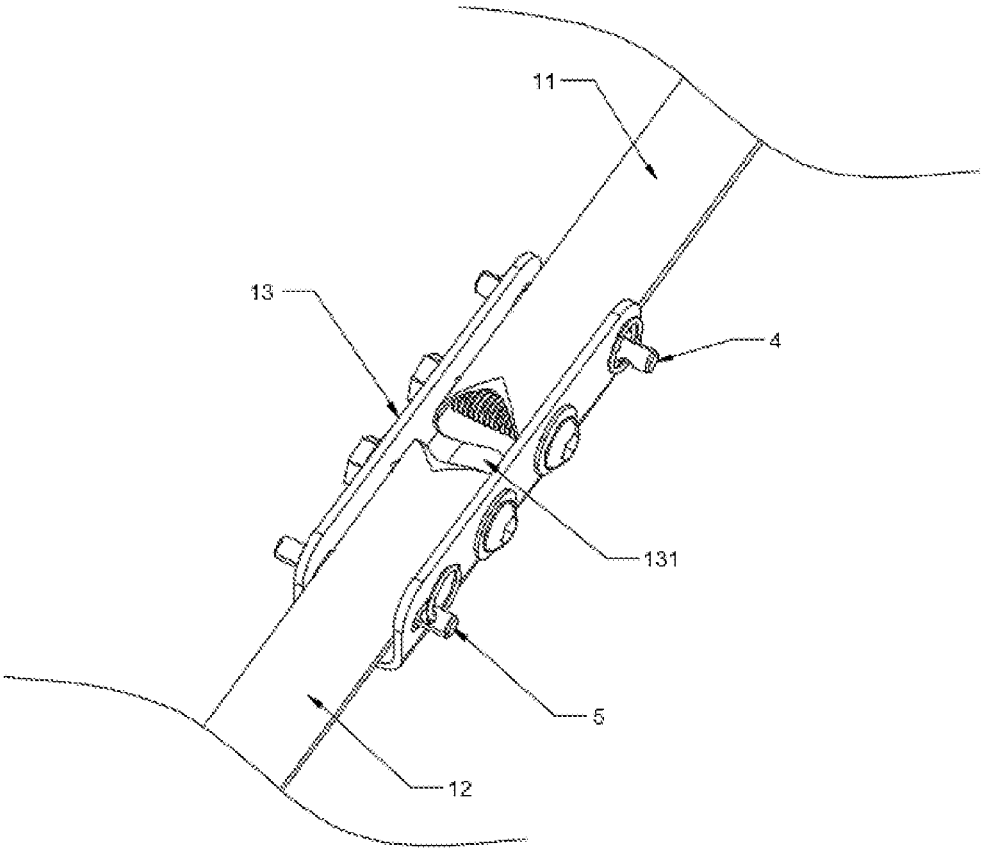
FIG. 3 is a schematic structural view showing a connecting part of the disclosure.

1—bracket; 11—bending part; 12—supporting part; 13—connecting part; 131—first groove; 2—rebound net; 3—hook buckle; 4—first pin; 5—second pin; 6—supporting base; 61—opening; 7—supporting rod; 71—inserting rod; 72—bolt; 73—adjusting rod; 74—supporting piece; 741—notch; 75—clamp; 76—connecting piece; 8—base; 81—second groove.

DETAILED DESCRIPTION OF EMBODIMENTS

The technical solutions in the embodiments of the disclosure will be described clearly and completely below. Apparently, the described embodiments are only some of the embodiments of the disclosure, not all of them. Based on the embodiments in the disclosure, all other embodiments obtained by those ordinary skilled in the art without creative work should fall within the scope of protection of the disclosure.

Referring to FIG. 1 to FIG. 4, a portable pickleball training net applied to the pickleball sport is provided in the embodiments of the disclosure. Specifically, the training net can assist the user to perform individual training, as long as it is placed in a relatively open field, with low requirements for the field. The portable pickleball training net includes a bracket 1 and a rebound net 2 mounted on the bracket 1. The bracket 1 is provided with multiple hook buckles 3 to fix the rebound net 2. A periphery of the rebound net 2 is connected to the multiple hook buckles 3 arranged on the bracket 1. The bracket 1 includes: a bending part 11, supporting part 12, and connecting parts 13. The bending part 11 and the supporting part 12 are hinged to the connecting parts 13; specifically, a bottom of the bending part 11 is hinged to the connecting part 13 and a top of the supporting part 12 is hinged to the connecting part 13. A first groove 131 configured to accommodate an end of the bending part 11 (also referred to as the bottom of the bending part 11) and an end of the supporting part 12 (also referred to as the top of the supporting part 12) is provided in each of the connecting parts 13. The bottom of the bending part 11 and the top of the supporting part 12 are arranged at two ends inside the first groove 131 respectively. An opening direction of the first groove 131 is set forward (i.e., faces towards a first direction) so that at least one of the bending part 11 and the supporting part 12 is capable of being rotated facing towards the first direction to fold the bending part 11 and the supporting part 12. In an embodiment, the connecting part 13 is detachably mounted with a first pin 4 and a second pin 5; specifically, the first pin 4 passes through the connecting part 13 and the bottom of the bending part 11, the bending part 11 is fixed on the connecting part 13 through the first pin 4. Correspondingly, the second pin 5 passes through the connecting part 13 and the top the supporting part 12, and the supporting part 12 is fixed on the connecting part 13 through the second pin 5. It can be understood that the connecting part 13 and the bending part 11 are formed with first openings and second openings configured to mount the first pin 4, and the connecting part 13 and the supporting part 12 are formed with third openings and forth openings configured to mount the second pin 5.

The supporting part 12 is located below the bending part 11, bottoms of the supporting part 12 are connected to a supporting base 6 which is rotatable. Detachable adjusting assembly is connected between the supporting base 6 and the supporting part 12. The supporting part 12, the supporting base 6 and the detachable adjusting assembly form a triangular supporting structure; and the detachable adjusting assembly is configured to adjust a tilt angle of the bracket 1.

Figure 4:
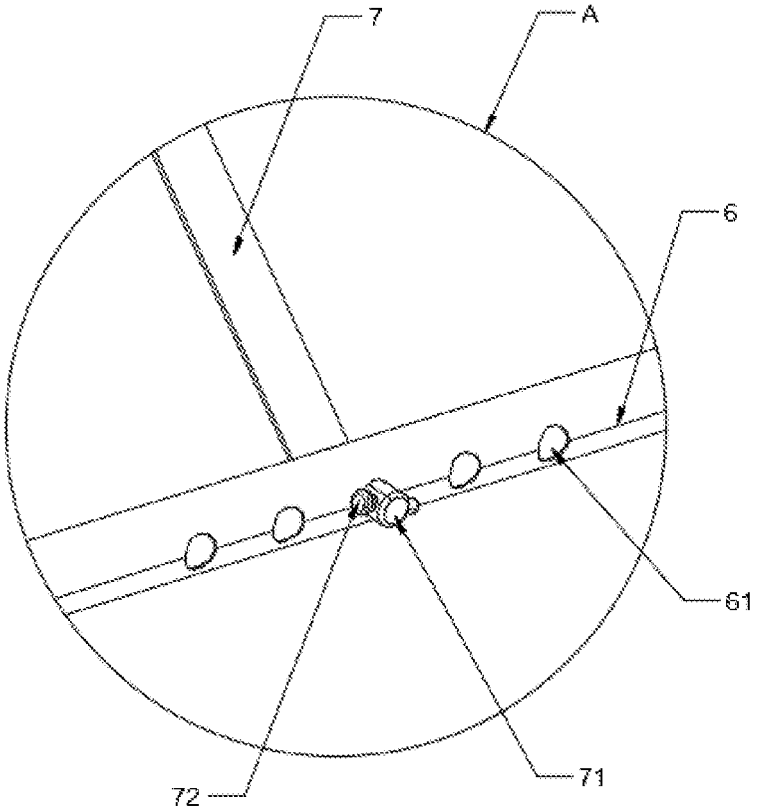
FIG. 4 is an enlarged view at a portion A of FIG. 1.

As shown in FIG. 1 and FIG. 4, in the first embodiment, the detachable adjusting assembly includes supporting rods 7; an upper end of each of the supporting rods 7 is hinged to the supporting part 12, a lower end of each of the supporting rods 7 is detachably connected to the supporting base 6. Specifically, the supporting base 6 is formed with multiple through holes 61, and a side surface of the lower end of each of the supporting rods 7 is provided with an inserting rod 71, and the inserting rod 71 can be mounted or inserted in any one of the through holes 61. A side of the inserting rod 71 is formed with a threaded hole, and a bolt 72 matched with the thread hole is mounted the side of the inserting rod 71, and the bolt 72 can prevent the inserting rod 71 from sliding out of the through hole 61 after assembling the pickleball training net.

Figure 6:
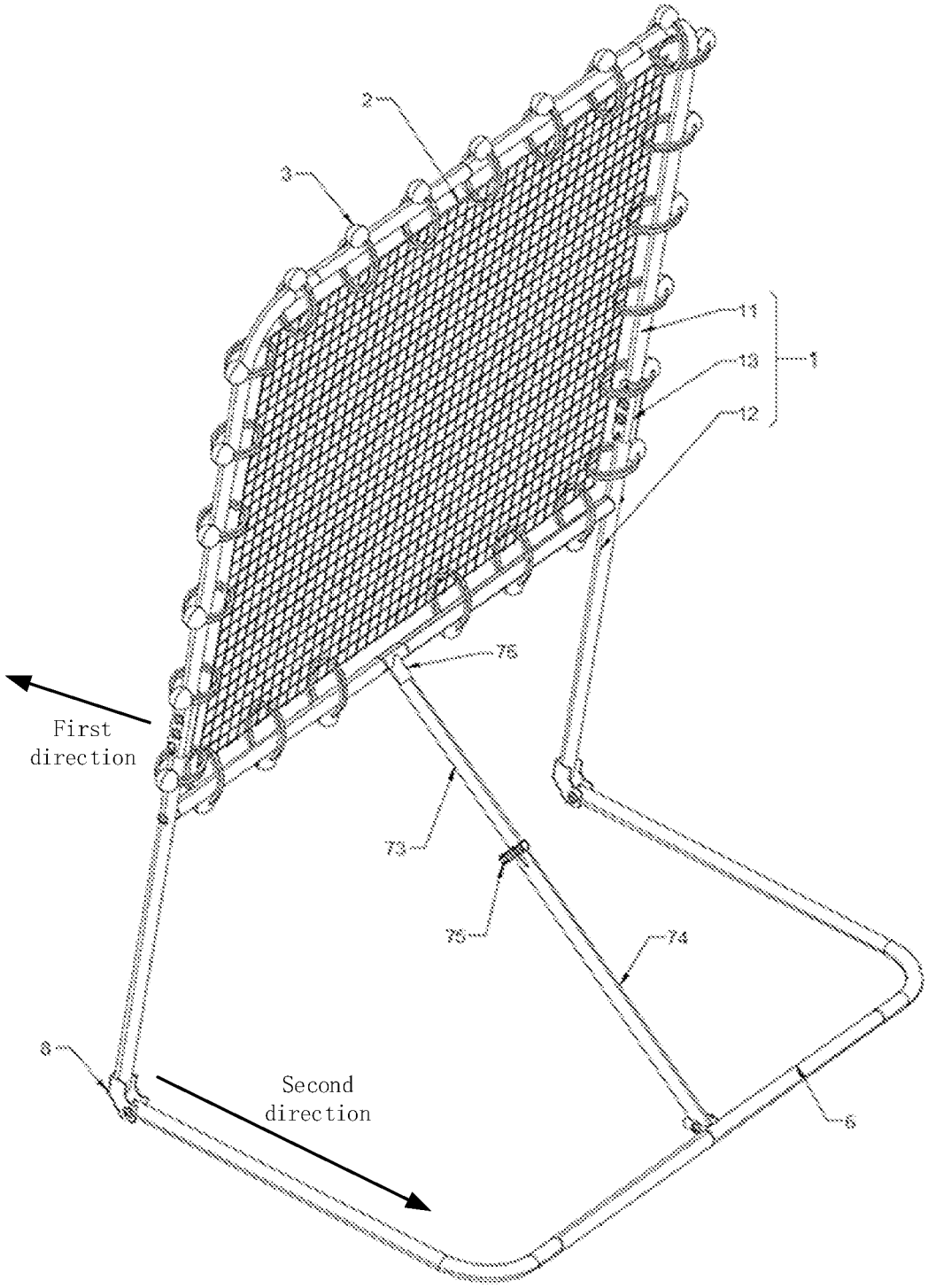
FIG. 6 is a schematic structural view of a portable pickleball training net according to a second embodiment of the disclosure.
Figure 7:
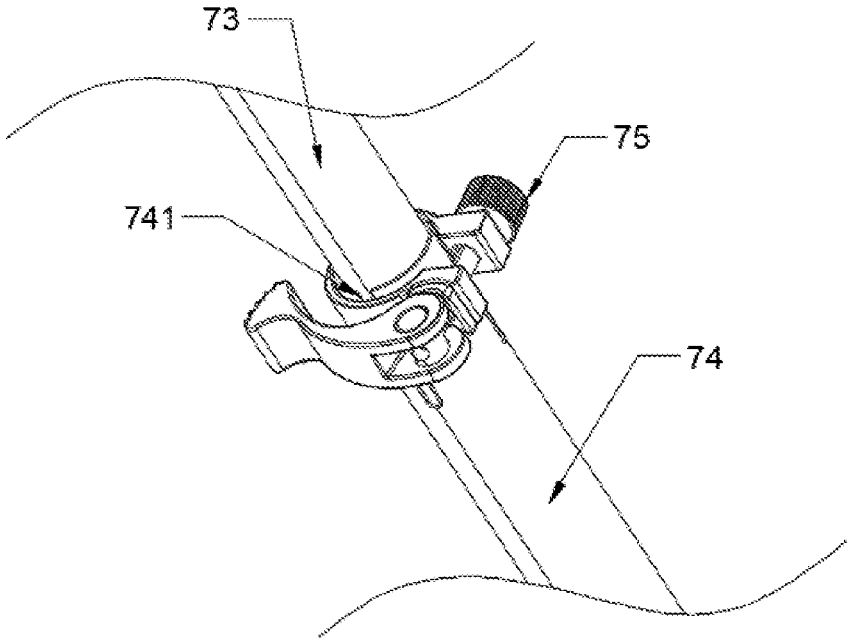
FIG. 7 is a schematic structural view showing a clamp of the disclosure.

As shown in FIG. 6 and FIG. 7, in the second embodiment, the detachable adjusting assembly includes a connecting piece 76, an adjusting rod 73, and a supporting piece 74. The connecting piece 76 is mounted on a middle section of the supporting part 12 and is rotatably matched with the middle section. An end of the supporting piece 74 is hinged to the supporting base 6, an end surface of another end of the supporting piece 74 is provided with a first inserting hole, the connecting piece 76 is provided with a second inserting hole, and two ends of the adjusting rod 73 are respectively inserted in the first inserting hole and the second inserting hole. Multiple notches 741 with an annual distribution are provided around the first inserting hole, the first inserting hole is sleeved with a clamp 75, and the clamp 75 is configured to fix the adjusting rod 73 when the adjusting rod 73 inserts into the second inserting hole.

Figure 5:
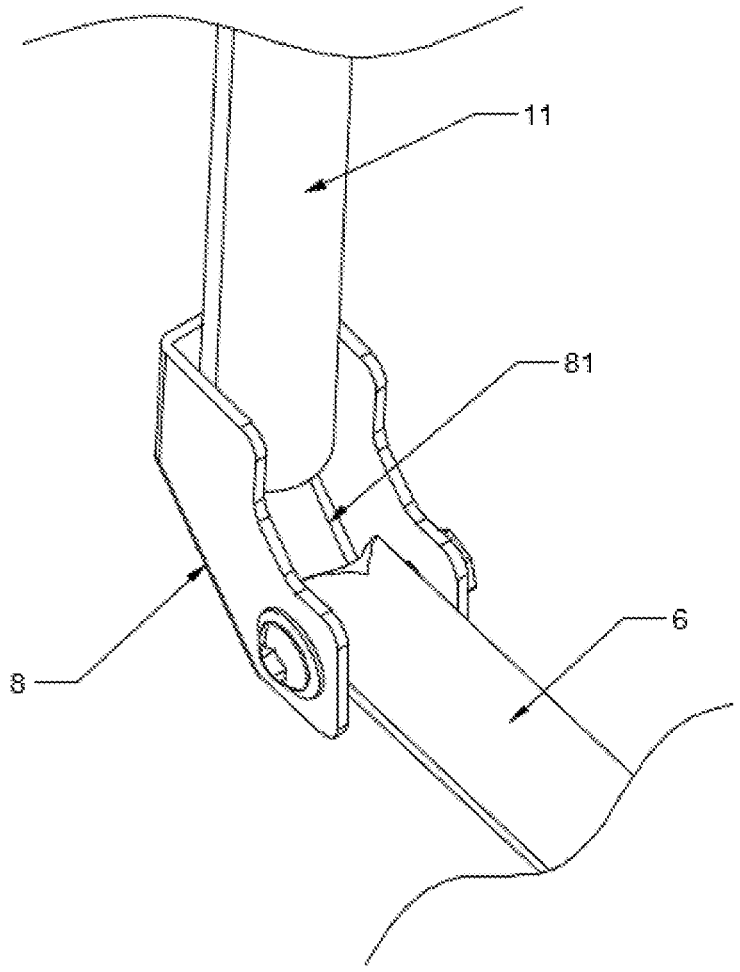
FIG. 5 is a schematic structural view showing a base of the disclosure.

As shown in FIG. 5, about the connection between the supporting part 12 and the supporting base 6: each of the bottoms of the supporting part 12 is provided with a base 8, the base 8 is in ʃ-shaped, and the base 8 is disposed in an inclined manner. The supporting part 12 and the supporting base 6 are hinged to the base 8, specifically, the bottom of the supporting part 12 is hinged to the base 8 and an end of the supporting base 6 is hinged to the base 8. The base 8 is provided with a second groove 81 configured to accommodate the bottom of the supporting part 12 and the end of the supporting base 6. The bottom of the supporting part 12 and the end of the supporting base 6 are respectively arranged at two ends inside the second groove 81. An opening direction of the second groove 81 is set backward (i.e., faces towards the second direction). When the inserting rod 71 is removed from the through hole 61 or when the adjusting rod 73 is removed from the second inserting hole, the supporting part 12 is capable of being rotated facing towards the second direction or the supporting base 6 is capable of being rotated facing upwards to thereby fold the supporting part 12 and the supporting base 6.

For those skilled in the art, it is apparent that the disclosure is not limited to the details of the above exemplary embodiments, and can be realized in other specific forms without departing from the spirit or basic features of the disclosure. Therefore, from any point of view, the embodiments should be regarded as exemplary and non-restrictive.

The scope of the disclosure is limited by the appended claims rather than the above description. Therefore, it is intended to include all changes within the meaning and scope of the equivalent elements of the claims in the disclosure.

What is claimed is:

1. A pickleball training net, applied to a pickleball sport, comprising a bracket and a rebound net mounted on the bracket;

wherein the bracket comprises: a bending part, a supporting part, and connecting parts; the bending part and the supporting part are hinged to the connecting parts;

wherein each of the connecting parts is formed with a first groove configured to accommodate an end of the bending part and an end of the supporting part; the end of the bending part and the end of the supporting part are disposed at two ends inside the first groove respectively; an opening direction of the first groove faces towards a first direction so that at least one of the bending part and the supporting part is capable of being rotated facing towards the first direction to fold the bending part and the supporting part;

wherein the supporting part is located below the bending part, bottoms of the supporting part are connected to a supporting base being rotatable and arranged along a second direction opposite to the first direction, and a detachable adjusting assembly is connected between the supporting base and the supporting parts; and the detachable adjusting assembly is configured to adjust a tilt angle of the bracket;

wherein the detachable adjusting assembly comprises supporting rods; an upper end of each of the supporting rods is hinged to the supporting part, a lower end of each of the supporting rods is detachably connected to the supporting base, the supporting base is formed with a plurality of through holes, a side surface of the lower end of each of the supporting rods is provided with an inserting rod, and the inserting rod is mounted in any one of the plurality of through holes; and wherein a side of the inserting rod is formed with a threaded hole, and a bolt matched with the thread hole is mounted at the side of the inserting rod.

2. The pickleball training net according to claim 1, wherein each of the bottoms of the supporting part is provided with a base; the supporting part and the supporting base are hinged to the base, the base is formed with a second groove configured to accommodate the bottom of the supporting part and an end of the supporting base, the bottom of the supporting part and the end of supporting base are respectively arranged at two ends inside the second groove, and an opening direction of the second groove faces towards the second direction; when the inserting rod is removed from the through hole, the supporting part is capable of being rotated to fold the supporting part and the supporting base.

3. The pickleball training net according to claim 1, wherein each of the connecting parts is detachably mounted with a first pin and a second pin, the first pin passes through the each of connecting parts and the bending part to fix the bending part on each of the connecting parts, and the second pin passes through each of the connecting parts and the supporting part to fix the supporting part on each of the connecting parts.

4. The pickleball training net according to claim 1, wherein the bracket is provided with a plurality of hook buckles to fix the rebound net.

5. A pickleball training net, applied to a pickleball sport, comprising a bracket and a rebound net mounted on the bracket;

wherein the bracket comprises: a bending part, a supporting part, and connecting parts; the bending part and the supporting part are hinged to the connecting parts;

wherein each of the connecting parts is formed with a first groove configured to accommodate an end of the bending part and an end of the supporting part; the end of the bending part and the end of the supporting part are disposed at two ends inside the first groove respectively; an opening direction of the first groove faces towards a first direction so that at least one of the bending part and the supporting part is capable of being rotated facing towards the first direction to fold the bending part and the supporting part;

wherein the supporting part is located below the bending part, bottoms of the supporting part are connected to a supporting base being rotatable and arranged along a second direction opposite to the first direction, and a detachable adjusting assembly is connected between the supporting base and the supporting part; and the detachable adjusting assembly is configured to adjust a tilt angle of the bracket; and wherein the detachable adjusting assembly comprises a connecting piece, an adjusting rod, and a supporting piece; the connecting piece is mounted on a middle section of the supporting part and is rotatably matched with the middle section; an end of the supporting piece is hinged to the supporting base; an end surface of another end of the supporting piece is formed with a first inserting hole, the connecting piece is formed with a second inserting hole, and two ends of the adjusting rod are respectively inserted in the first inserting hole and the second inserting hole.

6. The pickleball training net according to claim 5, wherein the first inserting hole is provided with a plurality of notches distributed around thereon, and the first inserting hole is sleeved with a clamp; and the clamp is configured to fix the adjusting rod and the supporting piece when the adjusting rod is inserted into the second inserting hole.

7. The pickleball training net according to claim 5, wherein each of the bottoms of the supporting part is provided with a base; the supporting part and the supporting base are hinged to the base, the base is formed with a second groove configured to accommodate the bottom of the supporting part and an end of the supporting base, the bottom of the supporting part and the end of supporting base are respectively arranged at two ends inside the second groove, and an opening direction of the second groove faces towards the second direction; when the adjusting rod is removed from the second inserting hole, the supporting part is capable of being rotated to fold the supporting part and the supporting base.

8. The pickleball training net according to claim 5, wherein each of the connecting parts is detachably mounted with a first pin and a second pin, the first pin passes through the each of connecting parts and the bending part to fix the bending part on each of the connecting parts, and the second pin passes through each of the connecting parts and the supporting part to fix the supporting part on each of the connecting parts.

9. The pickleball training net according to claim 5, wherein the bracket is provided with a plurality of hook buckles to fix the rebound net.

* * * * *